US006893277B2

(12) United States Patent
Parrish et al.

(10) Patent No.: US 6,893,277 B2
(45) Date of Patent: May 17, 2005

(54) SQUIB CONNECTOR ASSEMBLY WITH CPA

(75) Inventors: Jeffrey David Parrish, Westland, MI (US); Sheikh Habibur Rahman, Macomb Township, MI (US)

(73) Assignee: Tyco Electronics Corporation, Middletown, PA (US)

( * ) Notice: Subject to any disclaimer, the term of this patent is extended or adjusted under 35 U.S.C. 154(b) by 21 days.

(21) Appl. No.: 10/460,883

(22) Filed: Jun. 13, 2003

(65) Prior Publication Data

US 2004/0166715 A1 Aug. 26, 2004

Related U.S. Application Data

(60) Provisional application No. 60/450,379, filed on Feb. 26, 2003.

(51) Int. Cl.[7] ..... H01R 29/00; H01R 13/627

(52) U.S. Cl. ..... 439/188; 439/352

(58) Field of Search ..... 439/352, 188, 439/489, 620

(56) References Cited

U.S. PATENT DOCUMENTS 5,275,575 A * 1/1994 Cahaly et al. ..... 439/188
5,314,345 A * 5/1994 Cahaly et al. ..... 439/188
5,529,512 A 6/1996 Mlyniec
5,746,618 A * 5/1998 Gauker ..... 439/352
6,276,957 B1 * 8/2001 Seko et al. ..... 439/489
6,287,139 B1 * 9/2001 Seko et al. ..... 439/489
6,435,894 B2 * 8/2002 Little et al. ..... 439/352
6,461,184 B2 * 10/2002 Nimura ..... 439/352
6,488,518 B2 * 12/2002 Mlyniec ..... 439/180
6,699,059 B2 * 3/2004 Nagamine et al. ..... 439/352
6,743,051 B2 * 6/2004 Hayashi ..... 439/620

* cited by examiner

*Primary Examiner*—Gary Paumen

(57) ABSTRACT

An electrical connector includes a housing having a plug portion configured to be received in a receptacle. The housing has a rear face aligned with and opposing the plug portion. The housing includes a latch beam that is deflectable between a latched state and an unlatched state. A CPA mounted to the housing is movable between open and closed positions and includes a beam that extends through the rear face of the housing to engage the latch beam of the housing to inhibit the latch beam from deflecting to its unlatched state when the CPA is in a closed position.

20 Claims, 10 Drawing Sheets

SQUIB CONNECTOR ASSEMBLY WITH CPA

CROSS REFERENCE TO RELATED APPLICATIONS

This application claims the benefit of U.S. provisional application No. 60/450,379 filed Feb. 26, 2003.

BACKGROUND OF THE INVENTION

The invention relates generally to electrical connectors and more specifically to squib connectors for automotive air bag applications.

Vehicle airbag systems typically include one or more airbag units mounted within the passenger compartment of the vehicle to protect the occupants in the event of an accident. In order to deploy the airbag, an airbag inflation initiator or squib is activated in response to a signal from a deceleration sensor. The conventional squib unit typically contains an explosive material, such as gun powder, that is detonated upon receipt of an electrical signal to cause the rapid release of high pressure gas to inflate the airbag. The squib is therefore typically part of the airbag unit. A squib electrical connector is normally mated to the airbag inflation initiator or squib in order to connect lead wires or other conductors leading from the sensor unit. The electrical connector system permits independent assembly of the airbag unit and the sensor as well as the remainder of the airbag system, and also permits subsequent connection and disconnection for service or repair.

A common form of squib connector has two pins which extend within the socket. An associated connector has two terminals which are in electrical contact with the pins when the connector is plugged into the socket. When the connector is removed from the socket, typically for servicing, a shorting clip or shunt is biased into electrical contact with the two pins to form an electrical connection therebetween to reduce the risk of misfiring, for example, by static electricity. The connector urges the shorting clip out of electrical contact with the pins when the connector is plugged into the socket.

The integrity of the wire connection to the squib connector must be maintained to ensure that the squib connector will fire when the deceleration sensor senses a sufficiently great deceleration and sends a signal to the squib connector. The squib connector is particularly subject to failure due to handling during manufacture of the vehicle and during replacement of a spent air bag assembly.

A need exists for a squib connector that latches positively to provide a high retention force while having a low mating force. A further need exists for a squib connector wherein the electrical short circuit feature on the mating connector cannot be deactivated until the connector is fully mated.

BRIEF DESCRIPTION OF THE INVENTION

In one embodiment of the invention, an electrical connector is provided including a housing having a plug portion configured to be received in a receptacle. The housing has a rear face aligned with and opposing the plug portion. The housing includes a latch beam that is deflectable between a latched state and an unlatched state. A CPA mounted to the housing is movable between open and closed positions and includes a beam that extends through the rear face of the housing to engage the latch beam of the housing to inhibit the latch beam from deflecting to its unlatched state when the CPA is in a closed position.

In another embodiment of the invention, an electrical plug connector is provided that includes a housing having a plug portion configured to be received in a receptacle connector and having a rear face aligned with and opposing the plug portion. A is CPA mounted to the housing and is movable between open and closed positions. The CPA includes a shorting disconnect arm extending though the rear face of the housing, that separates a shorting clip and receptacle terminal held in the receptacle connector.

In yet another embodiment of the invention, a squib connector to be mated with a receptacle in an inflator for an automotive air bag is provided. The connector includes a housing configured to be mated with the receptacle and a latch to secure the housing to the receptacle. A CPA mounted to the housing and movable between open and closed positions includes a beam extending through the housing and engaging the latch when the CPA is in the closed position to inhibit the latch from unlatching. The CPA also includes a shorting disconnect arm extending though the rear face of the housing that separates a shorting clip and receptacle terminal held in the receptacle connector.

DETAILED DESCRIPTION OF THE INVENTION

Figure 1:
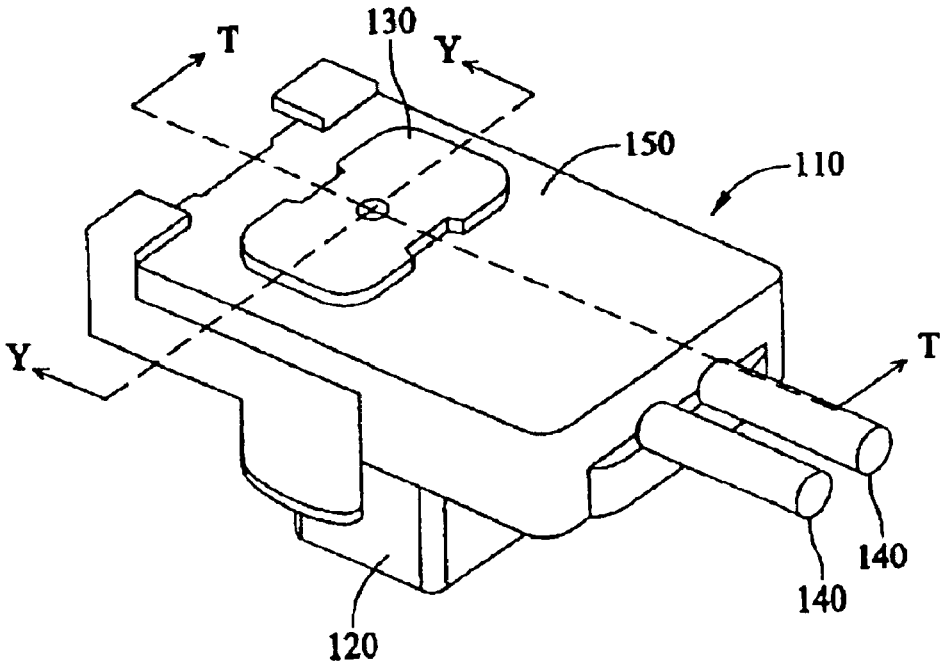
FIG. 1 is a top perspective view of a connector according to an embodiment of the present invention.

In FIG. 1, there is shown an electrical connector 100 suitable for use with the inflator receptacle for an automotive air bag. Connector 100 includes a housing 110 having a rear face 150. A plug portion 120 extends from the housing 110 in a direction opposite rear face 150. Connector 100 also includes a connector position assurance (CPA) device 130, which in FIG. 1 is shown inserted through the rear face 150. Housing 110 is configured to receive cables 140, such as from a sensor device (not shown).

Figure 2:
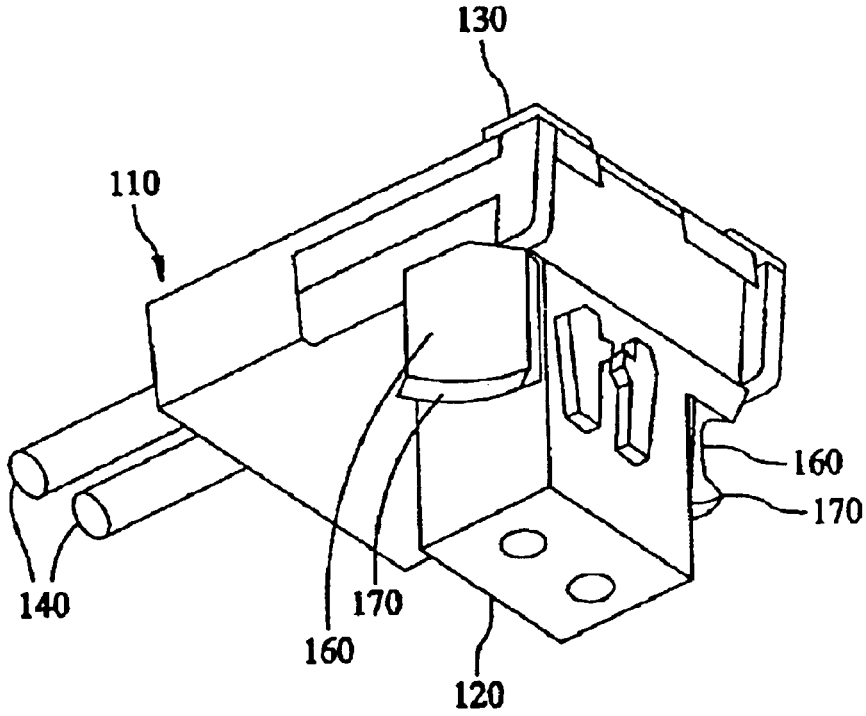
FIG. 2 is a perspective view of the bottom of the connector of FIG. 1.

As shown in FIG. 2, housing 110 includes a pair of latch beams 160 extending along opposite sides of plug portion 120. Latch beams 160 are deflectable between latched and unlatched states. Latch beams 160 terminate with a tang 170. The outer surface of latch beams 160 taper slightly inward to lower the connector mating force.

Figure 3:
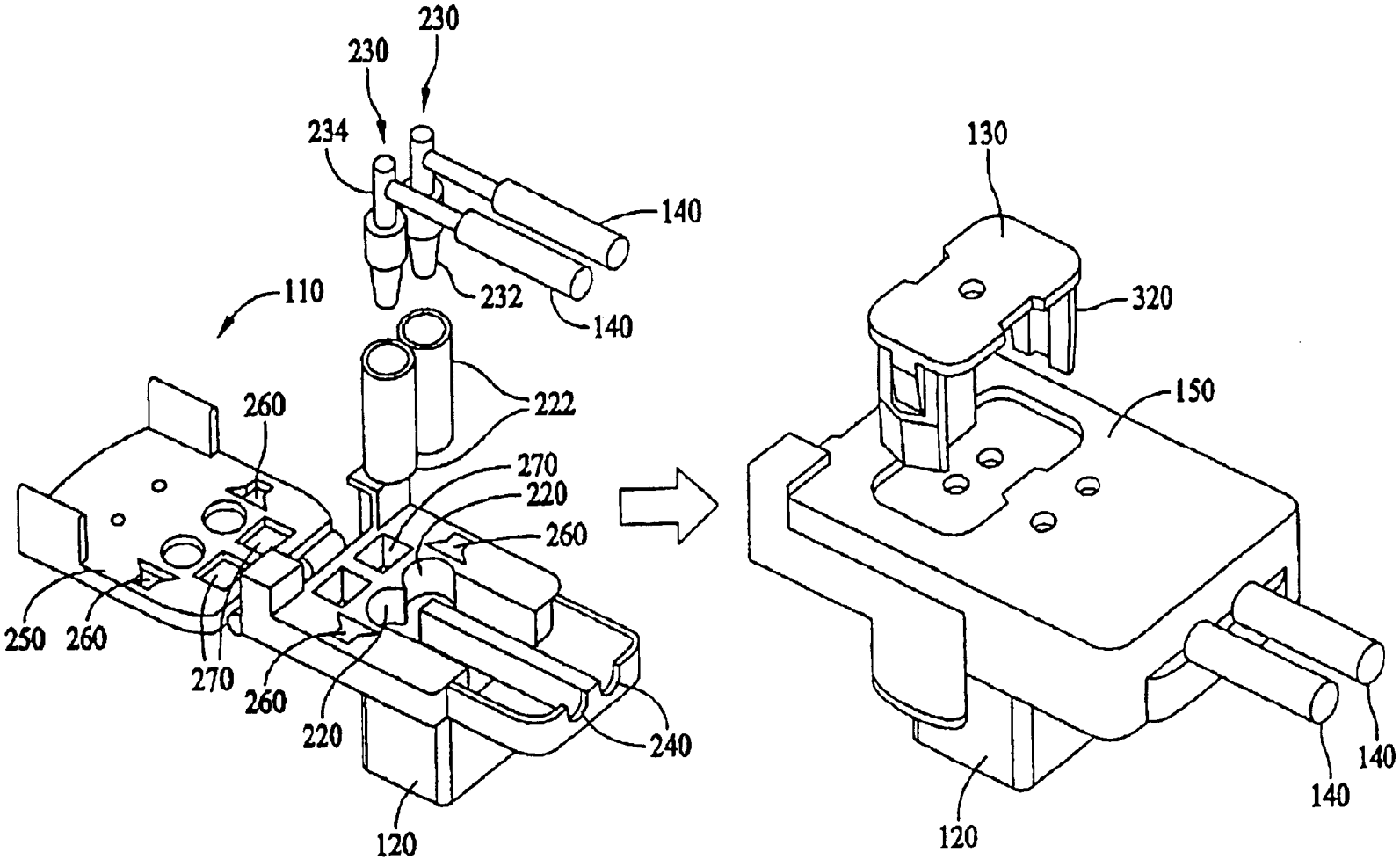
FIG. 3 is an exploded view of the connector of FIG. 1.

FIG. 3 illustrates the connector 100 in open and closed states. The connector 100 includes a connector housing 110 having a base 210 formed at a right angle to plug portion 120. Plug portion 120 and latch beams 160 extend downward from base 210. Base 210 includes a pair of right angle channels 220 that extend through base 210 and plug portion 120.

Right angle channels 220 include ferrite sleeves 222 for shielding. Ferrite material is used in a squib connector to suppress any unwanted Radio Frequency interference (RFI) signal that may inadvertently cause firing of the airbag. It is normally used in the airbag application in any of the following four methods. (1) A ferrite bead with two holes located inside the connector in such a way that the wires can pass through holes. In this case the ferrite bead may be made of a conductive, Manganese Zinc (MnZn), or a nonconductive, Nickel Zinc (NiZn) material. (2) A ferrite bead with two holes located inside the connector in such a way that the female contacts can reside inside the ferrite bead. In this case a nonconductive ferrite material should be used. (3) Two separate ferrite sleeves located inside the connector in such a way that the wires can pass through. In this case one or both of the ferrite sleeves material may be conductive. (4) Two separate ferrite sleeves located inside the connector in such a way that the female contacts can reside within the sleeves. In this case one of the ferrite sleeves material should be nonconductive.

In general conductive ferrite materials are more effective in suppressing interference (RFI) at low frequencies whereas the nonconductive ferrite material are more effective in suppressing interference (RFI) at high frequencies. The effectiveness of ferrite or ferrites in suppressing Radio frequency interference (RFI) also depends on the size of the ferrite bead or ferrite sleeves and its location. The closer the ferrite bead or ferrite sleeves are to the male and female electrical contact point or, in other words, the closer the ferrite to the electrical load (initiator of an airbag), the more effective it will be in suppressing the interference (RFI). A combination of ferrite material or materials, size, and location are selected in a particular squib connector design to achieve the most optimum effectiveness in suppressing RFI.

Ferrite sleeves 222 are received in right angle channels 220. Right angle terminal leads 230 are received in right angle channels 220 with contact beams 232 received in the ferrite sleeves 222. Terminal leads 230 are securable to cables 140. Terminal leads 230 are stamped at a ninety degree angle so that no additional bending after stamping is required. Each terminal lead 230 (see FIG. 11) is a tang-less contact and includes an angled body member 234 and three contact beams 232 at one end of body member 234, oriented to provide a spherical contact area (see FIGS. 12 and 13). Base 210 has a cable receiving portion 240 extending transversely relative to plug portion 120. A removable cover 250 is pivotably hooked to base 210. Cover 250 includes flanges 280 that engage the sides of base 210 when cover 250 is closed. Cover 250 and base 210 are provided with corresponding latch channels 260 and disconnect channels 270 for receiving CPA 130 which will now be described.

Figure 4:
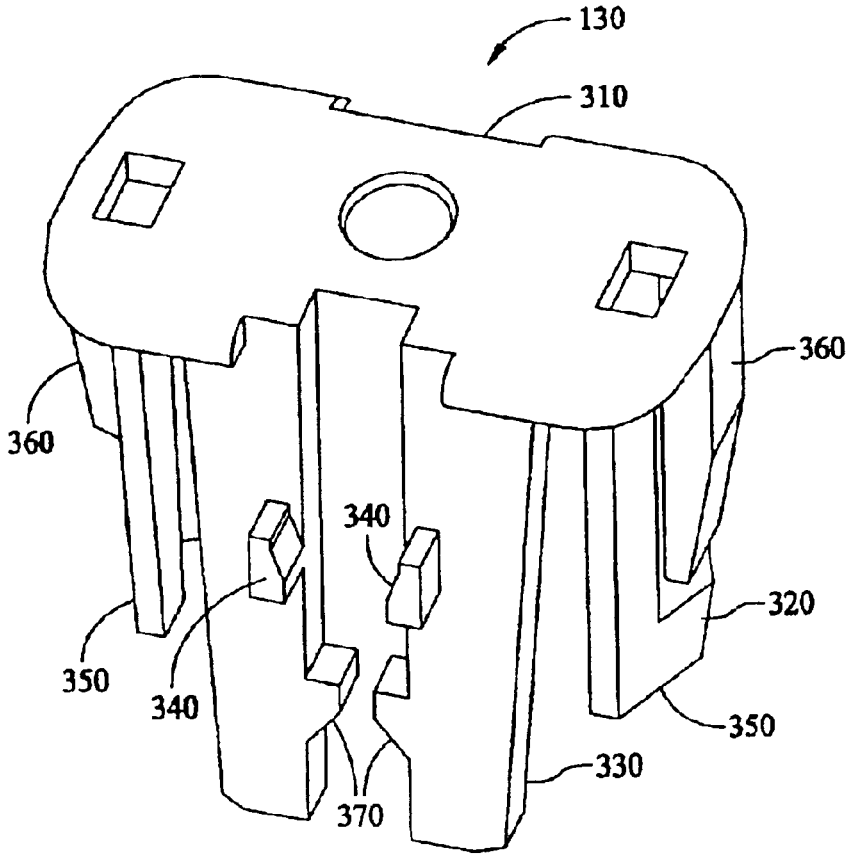
FIG. 4 is a perspective view of a CPA according to an embodiment of the present invention.

FIG. 4 illustrates the CPA 130 in detail. CPA 130 includes a base 310 which is substantially planar. A pair of beams 320 extend from opposite ends of base 310. Beams 320 have a tapered engagement end 350 and a shoulder portion 360 which extends from the periphery of base 310. A pair of shorting disconnect arms 330 extend from one side of base 310. Each of disconnect arms 330 has an embossment 340 on an outer side and a land 370 projecting toward each other. Arms 330 and beams 320 are substantially parallel to each other.

With reference to FIG. 3, connector 100 is assembled by inserting the ferrite sleeves 222 into the right angle channels 220 in base 210 and then inserting terminal leads 230 into right angle channels 220 such that contact beams 232 are received in the ferrite sleeves 222. Alternatively, the ferrite sleeves 222 may be placed over contact beams 232 and inserting the sleeved terminal leads 230 into the right angle channels 220. Cables 140 are the routed through cable receiving portion 240 in base 210 after which cover 250 is pivoted to a closed position. CPA 130 is then inserted through the rear face of housing 110 by inserting beams 320 into latch channels 260 and disconnect arms 330 simultaneously to disconnect channels 270. CPA 130 is pushed into housing 110 until lands 370 on disconnect arms 330 pass through disconnect channels 270 snapping into place. Embossments 340 on CPA 130 engage a CPA stop 180 (see FIG. 14) inside the connector housing 110 that inhibits CPA 130 from being depressed to a fully locked position until the connector 100 is fully mated with a receptacle. Connector 100 is now ready to be mated with a receptacle.

Figure 5:
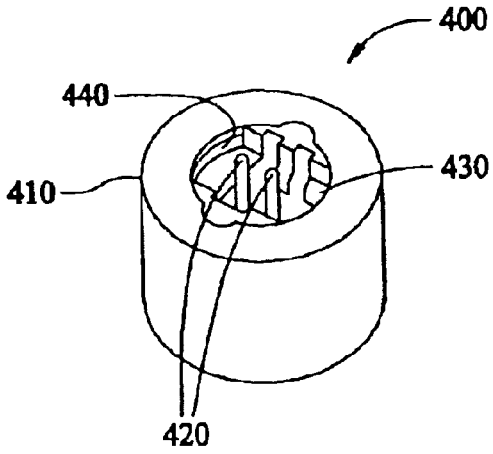
FIG. 5 is a perspective view of a squib socket suitable for use with the connector of FIG. 1.

FIG. 5 illustrates a squib socket 400 that is used in an air bag inflator receptacle. Socket 400 includes a body 410, terminal contacts 420 and shorting clip 430 which maintains a short across terminal contacts 420 to facilitate isolating the socket 400 from receiving any electrical signal that might inadvertently fire the airbag charge. Body 410 includes an interior circumferential groove 440.

Connector 100 is mated with the socket 400 by aligning latch beams 160 with cutouts 460 in inner liner 450 and inserting plug portion 120 into socket 400. The remainder of the mating operation will be described with reference to FIG. 14.

Figure 14:
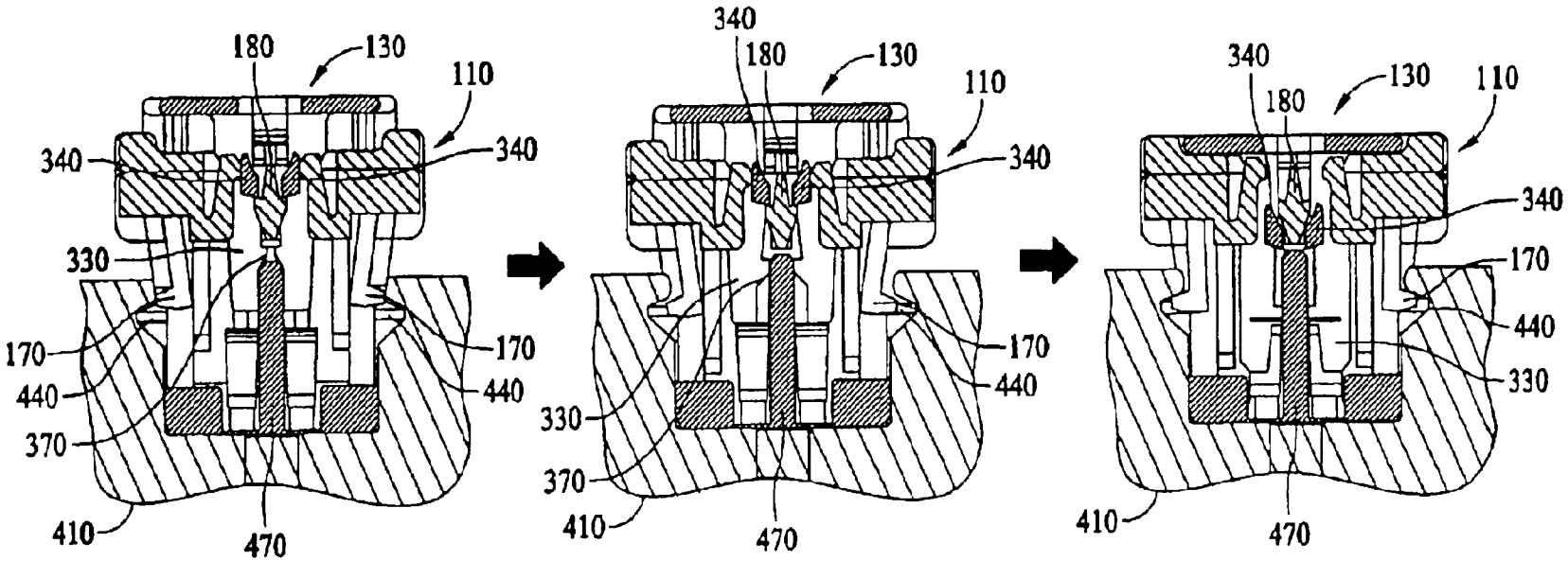
FIG. 14 is a schematic cross section of a connector and socket according to an embodiment of the present invention.

FIG. 14 shows a schematic cross section of the connector 100 and socket 400 progressively illustrating the mating process. As the mating operation progresses, lands 370 on disconnect arms 330 engage a post 470 inside socket 400 that spreads disconnect arms 330 apart laterally away from each other as the mating operation proceeds. At the same time, latch beam tangs 170 are moved into alignment with grooves 440 in the socket body 410. When the connector 100 is sufficiently inserted into the socket 400, the disconnect arms 330, and the embossments 340, are sufficiently spread apart from each other that the CPA stop 180 can pass between the embossments 340 on CPA 130. Latch beam tangs 170 are aligned with grooves 440 and mating is completed.

When mating is completed, CPA 130 can then be depressed closing CPA 130 which causes beams 320 to expand latch beams 160 into groove 440. Plug portion 120 extends along a mating axis and CPA 130 moves along the same mating axis when moved between open and closed positions. Simultaneously, disconnect arms 330 engage shorting to break the short between terminal contacts 420. However, since the CPA 130 cannot fully engage until mating is completed between connector 100 and socket 400, it is assured that terminal leads 230 are in contact with terminal contacts 420 before the short is broken. This is the mate before break feature of the connector 100 which is illustrated in more detail in FIGS. 6 and 7.

Figure 6:
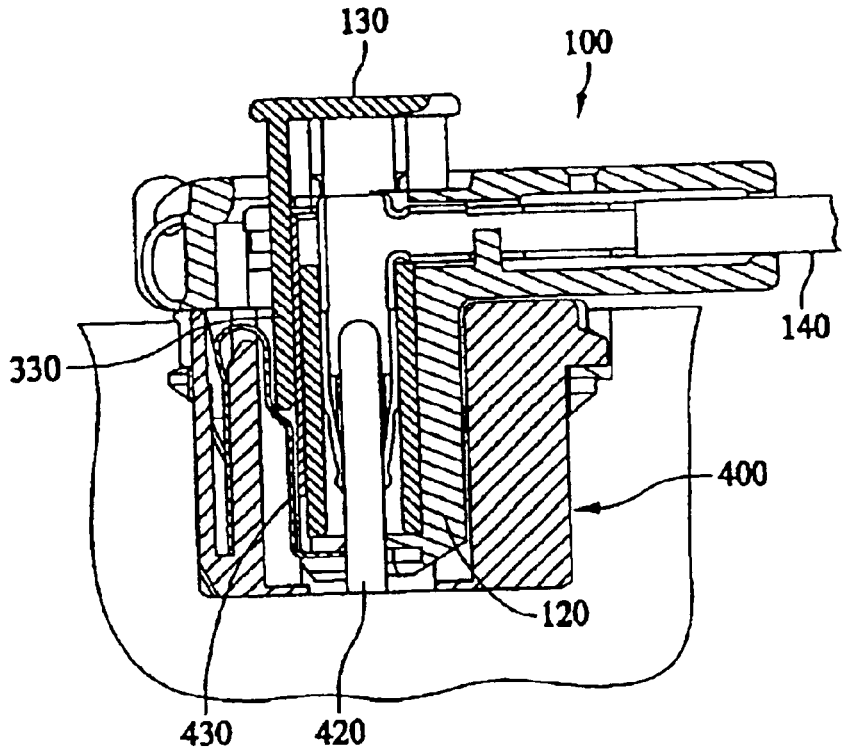
FIG. 6 is a cross sectional view along the cable axis of a mated connector with the CPA open.

FIGS. 6 is a cross sectional view of connector 100 illustrating the connector 100 fully mated with socket 400, but with CPA 130 open or not engaged. In this state, shorting clip 430 is in contact with terminal contacts 420. With CPA the 130 open, the disconnect arm 330 is in an elevated position relative to the shorting clip 430 and has not sufficiently engaged the shorting clip 430 to move the shorting clip away from the terminal contacts 420 to break electrical contact.

Figure 7:
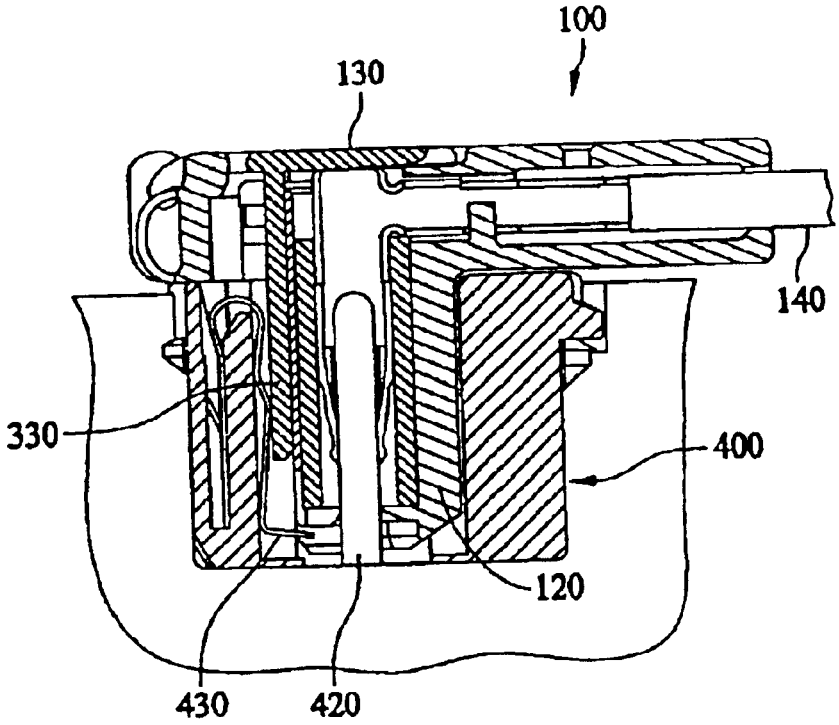
FIG. 7 is a cross sectional view taken along line T—T in FIG. 1 of a mated connector with the CPA closed.

FIG. 7 is a cross sectional view of connector 100 illustrating the connector 100 fully mated with socket 400, with CPA 130 closed or engaged. Disconnect arm 330 is shown forcing shorting clip 430 away from terminal contacts 420 thus breaking the short and rendering the air bag system ready for operation.

Figure 8:
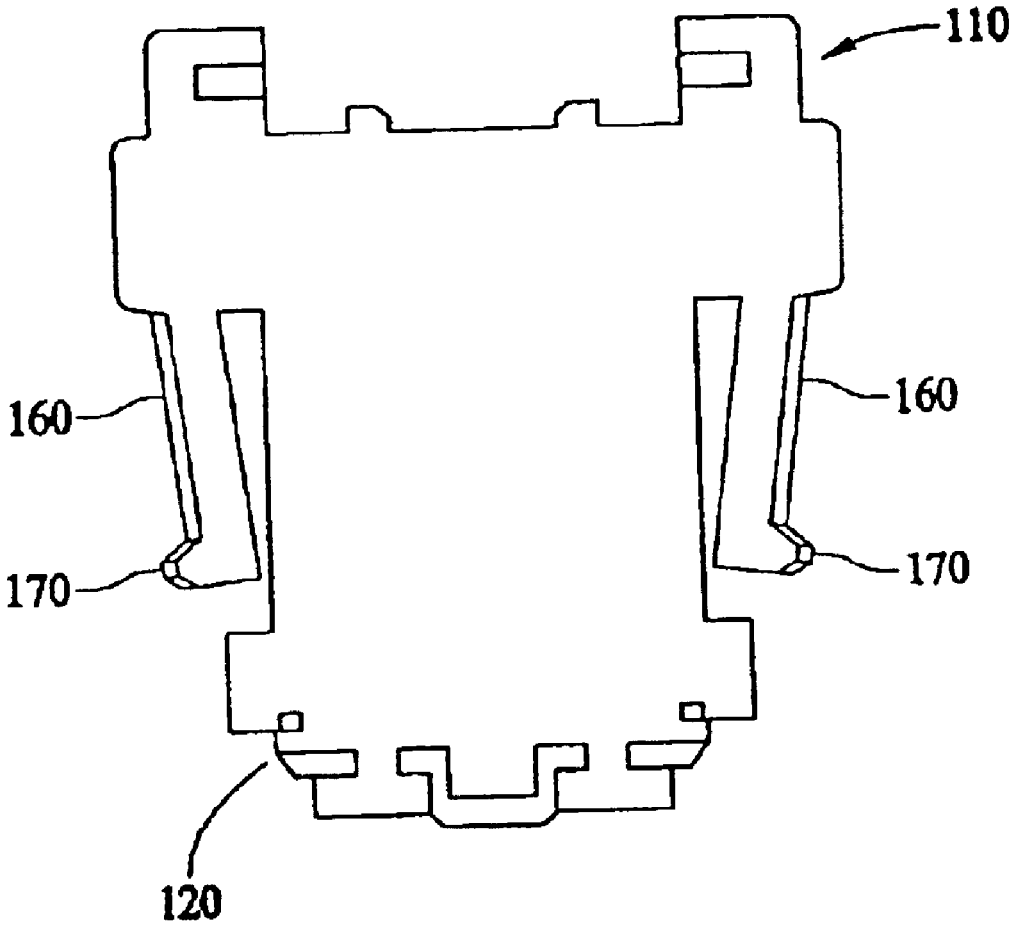
FIG. 8 is a front elevational outline view of a connector according to one embodiment of the present invention.

FIG. 8 is a front elevational outline of the connector 100 illustrating the low insertion force aspect of the connector 100. The connector 100 is constructed to provide an insertion force that is as low as possible without sacrificing retention force. As illustrated in FIG. 8, latch beams 160 are designed with an inward angle to lower the interference between the connector 100 and the mating squib socket, thus lowering the insertion force. Retention force, however, is retained as a result of the cooperation of latch beams 160 and the CPA 130 during the mating operation as shown in FIGS. 9 and 10.

Figure 9:
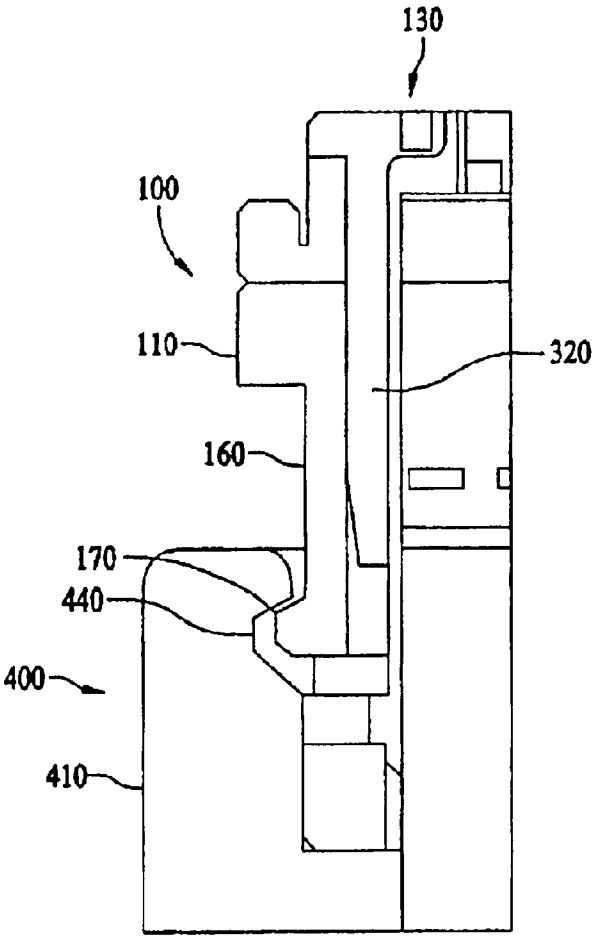
FIG. 9 is a cross sectional view taken along line Y—Y in FIG. 1 of a mated connector with the CPA open.

FIG. 9 is a cross-sectional view of the connector 100 mated with squib socket 400. The cross section is taken through the line Y—Y of FIG. 1. The connector 100 and socket 400 are fully mated, however, CPA 130 is not engaged. The tang 170 on latch beam 160 is aligned with and partially extend into the groove 440 in squib socket 400.

Figure 10:
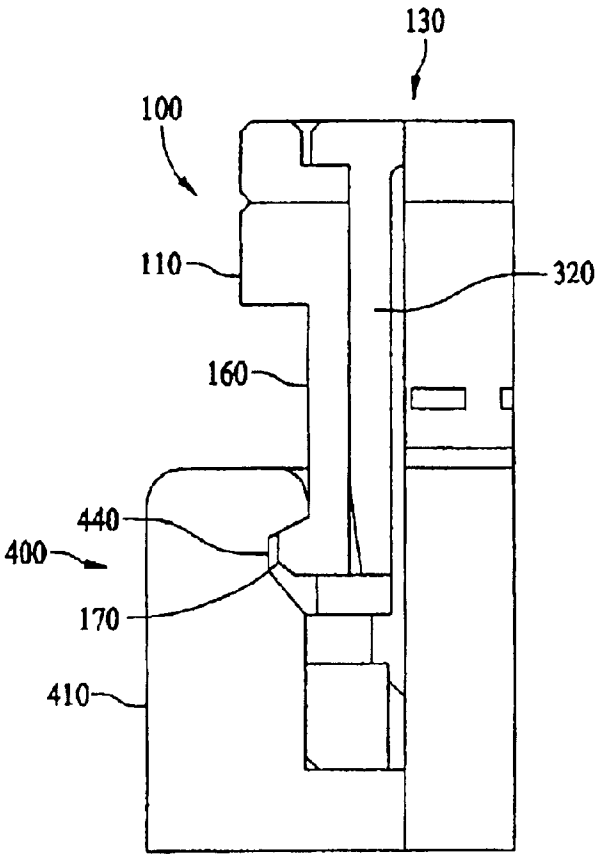
FIG. 10 is a cross sectional view taken along line Y—Y in FIG. 1 of a mated connector with the CPA closed.

FIG. 10 illustrates the mated connector 100 and squib socket 400 of FIG. 9, with the CPA 130 is engaged. The CPA beam 320 is depressed into the connector housing 110 moving the latch beam 160 outward. The outward movement of the latch beam 160 seats the latch beam tang 170 into groove 440 of squib socket 400 providing a higher retention force for the joined assembly.

Figure 11:
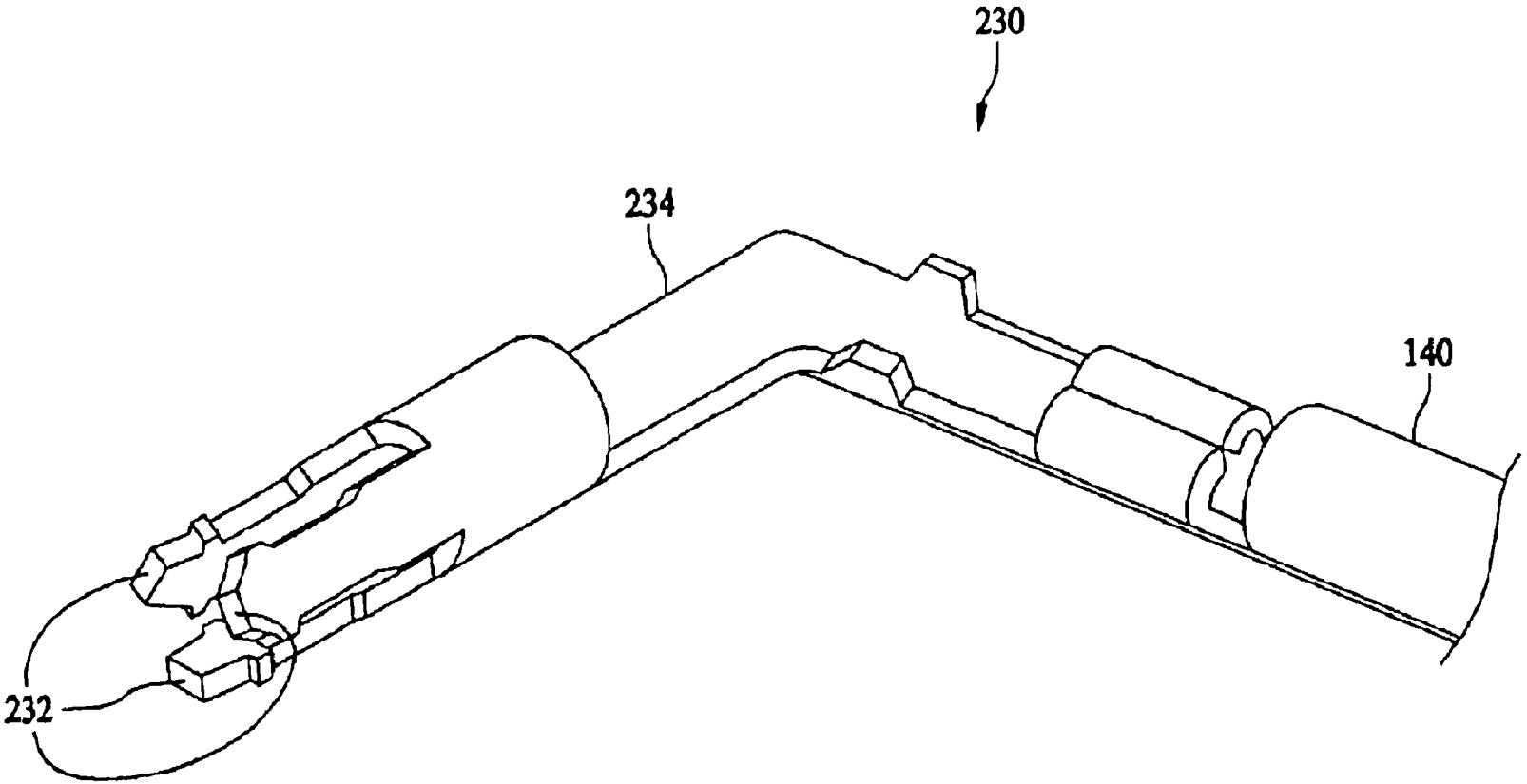
FIG. 11 is a perspective view of a right angle terminal lead.

FIG. 11 is a perspective view of the right angled terminal leads 230. Each terminal leads 230 is a tang-less contact securable to cables 140 and includes an angled body member 234 and three contact beams 232 at one end of body member 234.

Figure 12:
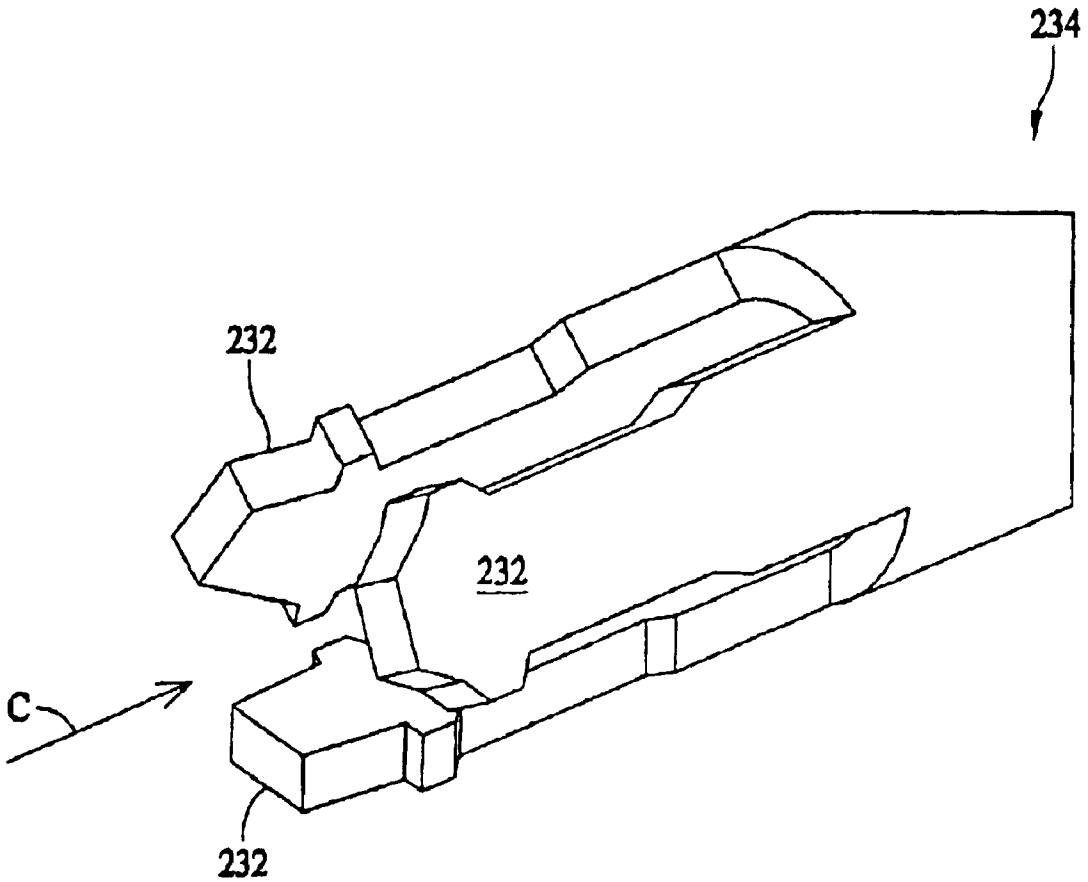
FIG. 12 is a perspective view of the contact beams of the right angle terminal lead of FIG. 11.

FIG. 12 illustrates the angled body member 234 and contact beams of the right angled terminal lead 230. The contact beams 232 are oriented to provide a spherical contact area.

Figure 13:
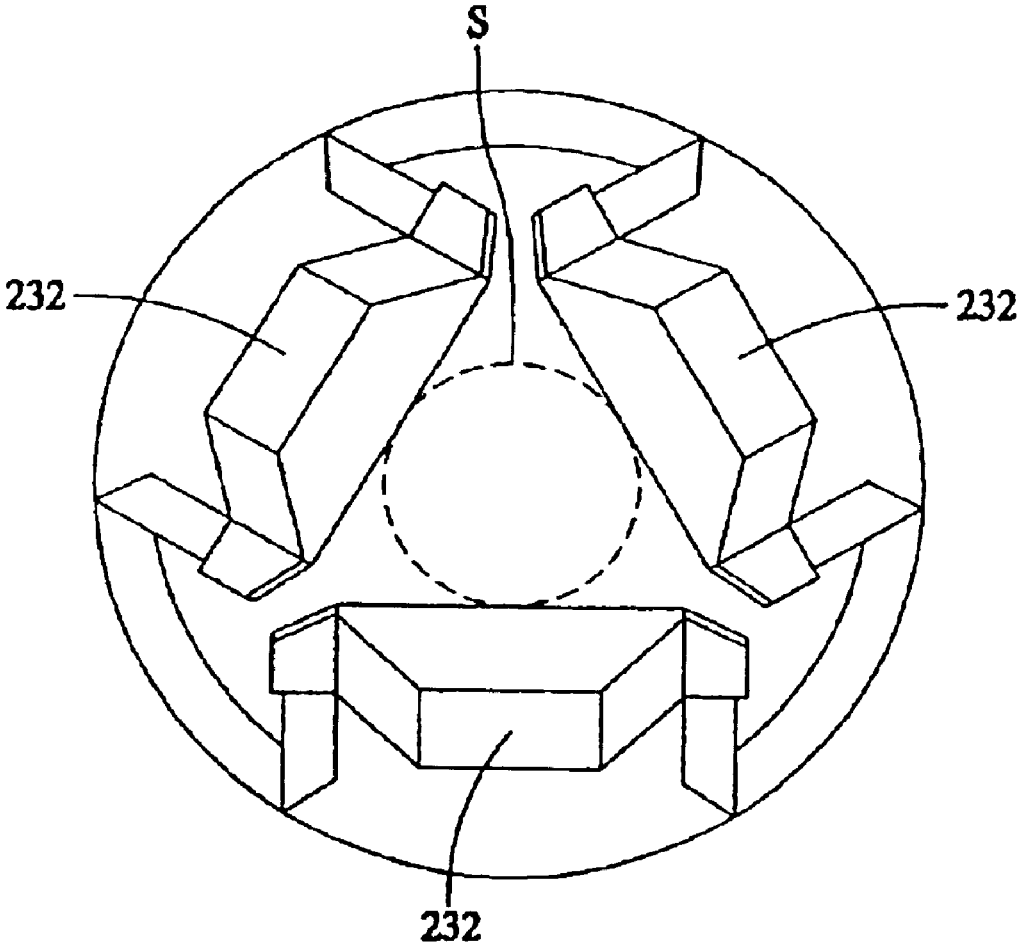
FIG. 13 is a view of the contact beams of FIG. 12 taken along the contact axis C.

FIG. 13 illustrates the spherical contact area of the contact beams 232 as viewed from the direction, indicated by arrow C, of a squib contact (see FIG. 12). The spherical contact area is represented by the dashed circle S. This spherical contact arrangement facilitates the maintenance of contact between the squib contact and the contact beams 232.

While the invention has been described in terms of various specific embodiments, those skilled in the art will recognize that the invention can be practiced with modification within the spirit and scope of the claims.

What is claimed is:

1. An electrical connector, comprising:

a housing having a plug portion configured to be received in a receptacle and having a rear face aligned with and opposing said plug portion, said housing having a latch beam extending along said plug portion, said latch beam being between and unlatched states;

a CPA mounted to said housing and movable between open and closed positions, said CPA having a beam extending through said rear face of said housing, said beam engaging said latch beam when said CPA is in said closed position to prevent said latch beam from deflecting to said unlatched state; and a CPA stop provided on said housing and positioned to inhibit said CPA from moving to said closed position until said plug portion is received in the receptacle.

2. The electrical connector of claim 1, wherein said housing includes a base formed at a right angle with said plug portion, said latch beam and plug portion extending parallel to one another from said base, said latch beam being angled inward toward said base to reduce insertion force.

3. The electrical connector of claim 1, wherein said housing includes right-angle channels extending there through, said channels including ferrite sleeves and receiving a pair of terminal leads securable to cables, said channels having a cable receiving portion extending within said housing transversely with respect to said plug portion.

4. The electrical connector of claim 1, wherein said housing includes a pair of latch beams and said CPA includes at least one disconnect arm separate from said pair of latch beams.

5. The electrical connector of claim 1, said plug portion extends along a mating axis, said CPA moving along said mating axis when moved between said open and closed positions.

6. The electrical connector of claim 1, said CPA further comprising a latch arm engaging said housing to hold said CPA in each of said open and closed positions.

7. The electrical connector of claim 1, said CPA further comprising a CPA base having a pair of said beams located on opposite ends thereof and a pair of shorting disconnect arms located along one side of said CPA base, said beams and arms extending parallel to one another.

8. An electrical connector, comprising:

a housing having a plug portion configured to be received in a receptacle and having a rear face aligned with and opposing said plug portion, said housing having a latch beam extending along said plug portion, said latch beam being deflectable between latched and unlatched states, -wherein said housing includes a removable cover pivotally hooked to said housing; and a CPA mounted to said housing and movable between open and closed positions, said CPA having a beam extending through said rear face of said housing, said beam engaging said latch beam when said CPA is in said closed position to prevent said latch beam from deflecting to said unlatched state, said CPA being mounted to said cover with said beam extending through said cover into said housing.

9. An electrical connector, comprising:

a housing having a plug portion configured to be received in a receptacle and having a rear face aligned with and opposing said plug portion, said housing having a latched beam extending along said plug portion, said latch beam being deflectable between latched and unlatched states;

a CPA mounted to said housing and movable between open and closed positions, said CPA having a beam extending through said rear face of said housing, said beam engaging said latch beam when said CPA is in said closed position to prevent said latch beam from deflecting to said unlatched state, said CPA further comprising a shorting disconnect arm extending though said rear face of said housing, said shorting disconnect arm being configured to separate a shorting clip and terminal held in the receptacle connector.

10. An electrical plug connector configured to join receptacle connector holding at least one receptacle terminal and an electrical shorting clip, the electrical plug connector comprising:

a housing having a plug portion configured to be received in a receptacle connector and having a rear face aligned with and opposing said plug portion, said housing including a latch beam deflectable between latched and unlatched positions; and a CPA mounted to said housing and movable between pen and closed positions, said CPA having a beam and a shorting disconnect arm extending though said rear face of said housing, said shorting disconnect arm being configured to separate a shorting clip and receptacle terminal held in the receptacle connector, said beam inhibiting unlatching of said latch beam.

11. The electrical plug connector of claim 10, wherein said shorting disconnect arm includes an embossment formed on an outer side thereof, said embossment being configured to engage an elbow formed at an intermediate point along the shorting clip to disengage the receptacle terminal and an outer end of the shorting clip.

12. The electrical plug connector of claim 10, wherein said housing includes a base formed at a right angle with said plug portion, said base including a cable opening in an end thereof, said shorting disconnect arm being located along a side of said plug portion opposed to said cable opening.

13. The electrical plug connector of claim 10, wherein said housing includes right-angle channels extending there through, said channels receiving a pair of terminal leads securable to cables, said channels having a cable receiving portion extending within said housing transversely with respect to said plug portion.

14. The electrical plug connector of claim 10, wherein said plug portion extends along a mating axis and said shorting disconnect arm moves parallel to said mating axis when moved to separate the shorting clip and receptacle terminal.

15. A squib connector configured to be mated with a receptacle in an inflator for an automotive air bag wherein the receptacle includes a shorting clip that shorts a pair of terminals to one another when the squib connector is disconnected, said squib connector comprising:

a housing configured to be mated with the receptacle;

a latch to secure the housing to the receptacle; and a CPA mounted to said housing and movable between open and closed said CPA comprising:

a beam extending through said housing, said beam engaging said latch when said CPA is in said closed position to prevent said latch from unlatching; and a shorting disconnect arm extending though said rear face said housing, said shorting disconnect arm being configured separate a shorting clip and receptacle terminal held in the receptacle connector.

16. The squib connector of claim 15, wherein said housing includes a base formed at a right angle with a plug portion, said latch and plug portion extending parallel to one another from said base.

17. The squib connector of claim 15, wherein said housing includes right-angle channels extending there through, said channels receiving a pair of terminal lead securable to cables.

18. The squib connector of claim 15, said CPA further comprising a CPA base having a pair of said beams located on opposite ends thereof and a pair of said shorting disconnect arms located along one side of said CPA base, said beams and arms extending parallel to one another.

19. The squib connector of claim 15, wherein said shorting disconnect arm includes an embossment formed on a side thereof, said embossment being configured to engage an elbow formed at an intermediate point along the shorting clip to disengage the terminal and an outer end of the shorting clip.

20. The squib connector of claim 15, wherein said housing includes a plug portion extending along a mating axis, said beam and shorting disconnect arm extending parallel to said mating axis and moving along said mating axis to block motion of said latch and to separate the shorting clip and receptacle terminal, respectively.

* * * * *